US007713151B2

(12) United States Patent
Fulton

(10) Patent No.: US 7,713,151 B2
(45) Date of Patent: May 11, 2010

(54) MECHANICAL BROADHEAD WITH EXPANDABLE BLADES

(76) Inventor: Brett Fulton, 661 Meadow Rd., North Huntingdon, PA (US) 15642

( * ) Notice: Subject to any disclaimer, the term of this patent is extended or adjusted under 35 U.S.C. 154(b) by 461 days.

(21) Appl. No.: 11/650,844

(22) Filed: Jan. 8, 2007

(65) Prior Publication Data

US 2007/0161438 A1 Jul. 12, 2007

Related U.S. Application Data

(60) Provisional application No. 60/756,971, filed on Jan. 6, 2006.

(51) Int. Cl.
*F42B 6/08* (2006.01)

(52) U.S. Cl. ..... 473/583

(58) Field of Classification Search ..... 473/583
See application file for complete search history.

(56) References Cited

U.S. PATENT DOCUMENTS

| | | | | |
|---|---|---|---|---|
| 64,045 | A | 4/1867 | Smith | |
| 126,388 | A | 5/1872 | Freeman | |
| 211,778 | A | 1/1879 | Pierce | |
| 1,222,142 | A | 4/1917 | Rossi | |
| 2,568,417 | A | 9/1951 | Steinbacher | |
| 2,770,905 | A | 11/1956 | Efraimson | |
| 2,993,697 | A | 7/1961 | Urban | |
| 3,036,395 | A | 5/1962 | Nelson | |
| 3,578,328 | A | 5/1971 | Rickey | |
| 4,099,720 | A | 7/1978 | Zeren | |
| 4,166,619 | A | 9/1979 | Bergmann et al. | |
| 4,468,038 | A | 8/1984 | Saunders | |
| 4,504,063 | A | 3/1985 | LeBus | |
| 4,505,482 | A | 3/1985 | Martin, Sr. | |
| 4,537,404 | A | 8/1985 | Castellano et al. | |
| 4,570,941 | A | 2/1986 | Saunders | |
| 4,579,348 | A | 4/1986 | Jones | |
| 4,615,529 | A | 10/1986 | Vocal | |
| 4,932,671 | A | 6/1990 | Anderson, Jr. | |
| 4,940,246 | A | 7/1990 | Stagg | |
| 4,973,060 | A | 11/1990 | Herzing | |
| 4,974,859 | A | 12/1990 | Briesemeister | |
| 4,976,443 | A * | 12/1990 | DeLucia | 473/583 |
| 4,998,738 | A | 3/1991 | Puckett | |
| 5,046,744 | A | 9/1991 | Eddy | |
| 5,064,202 | A | 11/1991 | Barner | |
| 5,066,021 | A | 11/1991 | DeLucia | |
| 5,078,407 | A | 1/1992 | Carlston et al. | |
| 5,082,292 | A | 1/1992 | Puckett et al. | |
| 5,083,798 | A | 1/1992 | Massey | |

(Continued)

*Primary Examiner*—John Ricci
(74) *Attorney, Agent, or Firm*—The Webb Law Firm

(57) ABSTRACT

A mechanical broadhead for attachment to an arrow having a broadhead body including a plurality of blade windows formed therein, a geometrically angled retractable blade attached within each of the blade windows, retaining springs for retaining the blades in a retracted position during flight, a front body slidably mounted onto the broadhead body, and a front tip secured to the front body. Upon contact with a target, the front tip and front body slide rearwardly into an end of the geometrically angled blades, thus pushing each of the blades through the blade windows into a deployed position. The blades of the broadhead are reset by inserting a sharp point underneath an end portion of the retaining springs and applying a slight twisting motion allowing the blades to retract back into the broadhead body into a loaded position.

22 Claims, 10 Drawing Sheets

U.S. PATENT DOCUMENTS

| | | | |
|---|---|---|---|
| 5,090,709 | A | 2/1992 | Johnson |
| 5,100,143 | A | 3/1992 | Puckett |
| 5,102,147 | A | 4/1992 | Szeluga |
| 5,112,063 | A | 5/1992 | Puckett |
| D326,889 | S | 6/1992 | Garoutte |
| 5,145,187 | A | 9/1992 | Lewis |
| 5,160,148 | A | 11/1992 | Musacchia, Sr. |
| 5,165,697 | A | 11/1992 | Lauriski et al. |
| 5,172,916 | A | 12/1992 | Puckett |
| 5,178,398 | A | 1/1993 | Eddy |
| 5,178,399 | A | 1/1993 | Garoutte |
| D342,303 | S | 12/1993 | Johnson |
| 5,322,297 | A | 6/1994 | Smith |
| 5,458,341 | A | 10/1995 | Forrest et al. |
| 5,472,213 | A | 12/1995 | Dudley |
| 5,482,293 | A | 1/1996 | Lekavich |
| 5,564,713 | A | 10/1996 | Mizek et al. |
| 5,621,974 | A | 4/1997 | Rose et al. |
| 5,624,459 | A | 4/1997 | Kortenbach et al. |
| 5,803,844 | A | 9/1998 | Anderson |
| 5,803,845 | A | 9/1998 | Anderson |
| 5,820,498 | A | 10/1998 | Maleski |
| 5,857,930 | A | 1/1999 | Troncoso |
| 5,879,252 | A | 3/1999 | Johnson |
| 5,941,784 | A | 8/1999 | Mizek |
| 6,015,357 | A | 1/2000 | Rizza |
| 6,171,206 | B1 | 1/2001 | Liechty, II |
| 6,200,237 | B1 | 3/2001 | Barrie |
| 6,217,467 | B1 | 4/2001 | Maleski |
| 6,258,000 | B1 | 7/2001 | Liechty, II |
| 6,270,435 | B1 | 8/2001 | Sodaro |
| 6,283,880 | B1 | 9/2001 | Barrie |
| 6,287,223 | B1 | 9/2001 | Liechty, II |
| 6,287,224 | B1 | 9/2001 | Liechty, II |
| 6,306,053 | B1 | 10/2001 | Liechty, II |
| 6,322,464 | B1 | 11/2001 | Sestak |
| 6,398,676 | B1 | 6/2002 | Mizek |
| 6,517,454 | B2 | 2/2003 | Barrie et al. |
| 6,554,727 | B1 | 4/2003 | Armstrong et al. |
| 6,595,881 | B1 | 7/2003 | Grace, Jr. et al. |
| 6,605,012 | B2 | 8/2003 | Muller |
| 6,626,776 | B2 | 9/2003 | Barrie et al. |
| 6,669,586 | B2 | 12/2003 | Barrie et al. |
| 6,743,128 | B2 | 6/2004 | Liechty, II |
| 6,749,801 | B1 | 6/2004 | Grace, Jr. et al. |
| 6,755,758 | B2 | 6/2004 | Liechty, II |
| 6,758,774 | B2 | 7/2004 | Liechty, II |
| 6,793,596 | B1 | 9/2004 | Sullivan et al. |
| 6,830,523 | B1 | 12/2004 | Kuhn |
| 6,910,979 | B2 | 6/2005 | Barrie et al. |
| 6,935,976 | B1 | 8/2005 | Grace, Jr. et al. |
| 6,939,258 | B2 | 9/2005 | Muller |
| 2002/0151394 | A1 | 10/2002 | Arasmith |

* cited by examiner

MECHANICAL BROADHEAD WITH EXPANDABLE BLADES

CROSS REFERENCE TO RELATED APPLICATION

The present application claims priority to U.S. Provisional Application Ser. No. 60/756,971 filed Jan. 6, 2006.

BACKGROUND OF THE INVENTION

1. Field of the Invention

The present invention relates generally to a mechanical broadhead for attachment to an arrow and, in particular, to a mechanical broadhead that has blades which are retracted into the body of the broadhead during flight and open upon impact with the target.

2. Description of Related Art

Previously designed mechanical broadheads that are well-known in the art were constructed to lessen the wind effects on the arrow and to provide a wounding shot that would kill the animal more quickly. There have been various designs that enable the blades to be held in during flight and to expand outward upon impact. The retractable blades in various prior art designs enable the arrow to fly straighter than a fixed blade broadhead because of the elimination of the extended blades that are able to deter the arrow off target (wind plane). Also, as the blades are extended, the intention is to cut a hole that will lead to hemorrhaging, resulting in a faster kill of the target animal. Some of the past designs have put much stress on the blades, which posed the threat that the blades would crack upon striking the target. Also, many of the past broadheads had blades that would extend from the front to the back, which slowed the arrow upon entry and decreased shot inertia, thus creating less penetration.

U.S. Pat. No. 6,517,454 to Barrie et al. describes a broadhead body as a single, longitudinally extending passage for receiving blades. The blades are held within their respective grooves with friction holding members which permit rearward sliding movement, resulting in outward expansion. During flight, the blades are not fully contained within the body.

U.S. Pat. No. 6,398,676 to Mizek describes a broadhead with blades that can be maintained in a normally closed position, with a major portion of each blade being housed within a slot of the body, and the blades pivoting rearwardly into an open position upon target impact. The blades have a rounded blunt tip portion that initially contacts a target. The arrowhead also contains various types of springs and engaging elements that can be used to maintain the blades in a normally closed position, which also provide a bias force that can be overcome by an opening force applied to the blade when in the closed position.

U.S. Pat. No. 6,270,435 to Sodaro describes spring-loaded blades that release and penetrate a target as the target is struck by the arrow. The externally exposed blades are not concealed within the body and are held together by a releasable ring.

U.S. Pat. No. 6,015,357 to Rizza discloses a broadhead for use as both an expandable blade head and a fixed blade head. The broadhead is described as a blade assembly that has an elastic ring which extends around the hypotenuse of each blade and in one annular groove in the body when the blade is in the retracted mode, with the tension of the elastic ring and the annular groove chosen determining the amount of force necessary for the blade assembly to achieve an expanded position, and with the blade assembly achieving the expanded position after the blade assembly has entered a prey. The barb on each blade contacts hard tissue causing the three blades to pivot outwardly and backwardly until the base of each blade sits in the associated slot and the elastic ring jumps out of the groove and becomes lodged around the base of each blade, causing the blade assembly to be maintained in the expanded position.

U.S. Pat. Nos. 5,112,063, 5,100,143, and 4,998,738 to Puckett and 5,082,292 to Puckett et al. describe broadheads for hunting arrows wherein the broadheads have deployable cutting blades which are held against the broadhead body during flight. U.S. Pat. No. 5,112,063 teaches the use of a tubular restraint for holding the cutting blades against the broadhead body during flight. When the broadhead impacts against an animal, a plunger, which is slidably mounted in the front of the body, is forced into the body and causes the blades to be deployed out of the slots. As the blades are moved out of the slot, the tubular restraint is cut from the body by the cutting edge. U.S. Pat. Nos. 5,100,143 and 4,998,738 teach a broadhead that includes a pair of upper blades and a pair of lower blades which are held within slots in a cylindrical body while the arrow is in flight. Upon impact with an animal, a plunger tip slides into the cylindrical body and upper and lower blades are forced to their open position by acting against the cam surfaces positioned within the cylindrical body. A C-shaped ring performs the function of holding the plunger tip in its extended position in flight and locking the blades in their open position upon impact. U.S. Pat. No. 5,082,292 to Puckett et al. teaches a broadhead with deployable cutting blades which are cammed open from slots in a cylindrical body as the plunger impacts against a game animal. The cutting blades are connected by pivot pins to the plunger. The cutting blades are pivotable when the broadhead is in an open position from the open, cutting configuration, which causes maximum hemorrhaging to a non-barbed configuration. Similarly to the '063 patent, a tubular restraint serves to hold the cutting blades within their respective slots during the flight of the arrow.

U.S. Pat. No. 5,102,147 to Szeluga discloses a ballistic broadhead assembly that maintains the blades, pivotably mounted on an actuating plunger, in a retracted condition until impact, thereupon thrusting them outwardly and forwardly for maximum effect, and ultimately constraining them against full retraction in a partially extended, optimal position. An additional pair of fixed blades may be mounted adjacent the rearward end of the body.

U.S. Pat. No. 4,932,671 to Anderson, Jr. describes an expandable blade broadhead that has a plurality of blades pivotally mounted on a circular ring. The ring is retained between a cap mounted on a stud extending from the front end of a ferrule and the ferrule. A hardened steel tip is slidably mounted in a bore in the cap, and is formed with a rearwardly facing cam surface. The blades are normally held retracted in slots in the ferrule body and cap, and the tip is normally held in an extended position. When the broadhead impacts a target, the tip is forced rearwardly, forcing the cam surface against the blades pivoting them out of the slots to a rearwardly inclined position. To facilitate extraction, the blades may pivot freely to a forwardly inclined position and the rear edges of the blades are sharpened.

U.S. Pat. No 4,099,720 to Zeren describes an expanding arrowhead having pivotally mounted blades within slots of a housing. The blades are retracted for minimum outward extension during flight but expanded and retained in an outwardly extended position upon impact with a target. The blades are retained in the retracted position by frictional engagement with the slots or by frangible or resilient members. Minimal size with maximum blade mounting strength can be obtained by orienting the blade mounting slots within the body in an offset relation to the central axis thereof. The blades are retained by transverse set screws, retaining pins or the like for easy attachment or removal. The blades can be retained in a forwardly oriented direction by a frictional engagement means, an elastic or frangible band, slotted frangible cap, or the like.

Each of the above-described previously used arrowheads operate differently and utilize different arrangements for retaining the blades in a retracted position. Some arrangements, which use frictional engagement for retaining the blades, do not appear as though they will work properly. Some arrangements are complex and require a large number of working parts. Other arrangements require specially machined components in order for the blades to deploy properly. What is needed is a simple yet effective design for holding cutting blades of a broadhead in a retracted position during flight and can quickly and effectively deploy these blades upon contact with a target, which is generally capable of use on most broadheads with deployable blades.

SUMMARY OF THE INVENTION

It is, therefore, an object of the present invention to provide a mechanical broadhead that will address the problems of previous designs and will provide an innovative broadhead for the future. It is another object of the present invention to provide a broadhead that flies like a field tip with no blade exposure, with the blades fully enclosed within the body, but when deployed, the blades lock and enable the broadhead to perform like a fixed blade broadhead. It is a further object of the present invention to provide an efficient broadhead that creates a minimal amount of difficulty when resetting, eliminates the possibility of material breakdown and eliminates the need for disposable parts. It is another object of the invention to provide an overall stronger broadhead by the use of stronger materials and an effective design, thus allowing the transition of kinetic energy from the direct connection of the front tip through the broadhead body into the arrow which enables easier entry into the target without putting the impact on susceptible parts like hinge pins or blades. It is yet another object of the invention to provide non-barbing back-cut on the cutting blades to ease withdrawal of the deployed broadhead from the body of the target. Another object of this invention is to minimize deployment stroke and provide a forward moving blade deployment that will allow a better arrow flight, better transition of kinetic energy from the front tip through the arrow, a more deadly cut when there is not a complete pass through, and minimal inertia reduction upon deployment and entry into the target. Yet another object of the invention is to provide a broadhead front tip design that allows for an increased front load and deeper penetration upon contact with the target.

I have invented a mechanical broadhead for attachment to an arrow comprising a broadhead body having a first end capable of removable attachment to an end of an arrow, a second end including a frontal post extending therefrom, and a body portion including a plurality of blade windows formed therein. A retractable blade is attached within each of the blade windows. The blades have a geometrically angled shape and an aperture at one end thereof for attachment within each of the blade windows. A retaining spring retains each of the blades in a retracted position within each of the blade windows. A front body is provided having a frontal end and a rearward end. The rearward end is slidably mounted onto the frontal post extending from the broadhead body. The front body includes at least one aperture extending through a sidewall portion thereof. Connecting members enter through the apertures of the front body and the apertures of each of the blades to slidably secure the front body to the broadhead body and to pivotally secure each of the blades within the broadhead body. A front tip is removably secured to the forward end of the front body, such that upon contact with a target, the front tip and front body slide rearwardly and apply a force into an end of the geometrically angled blades, causing each of the blades to pivot outwardly through the blade window into a deployed position.

The current invention reduces stress on the blades, provides an improved cutting design, and has a geometrically unique design for the front tip, front body, broadhead body, cutting blades, and retaining springs to work together. The design of this invention, specifically the geometry of the blade angle and the outside and inside razor edges of the blades in conjunction with the front tip, the front body, and the broadhead body, will provide an improved broadhead that will achieve a better arrow flight, better transition of kinetic energy from front tip through arrow, and a more deadly cut when there is not a complete pass through.

BRIEF DESCRIPTION OF THE DRAWINGS

The foregoing aspects and advantages will be better understood from the following detailed description of a preferred embodiment of the invention with reference to the drawings, in which the details and drawings are identified as follows.

DETAILED DESCRIPTION OF THE INVENTION

Figures 1A, 1B:
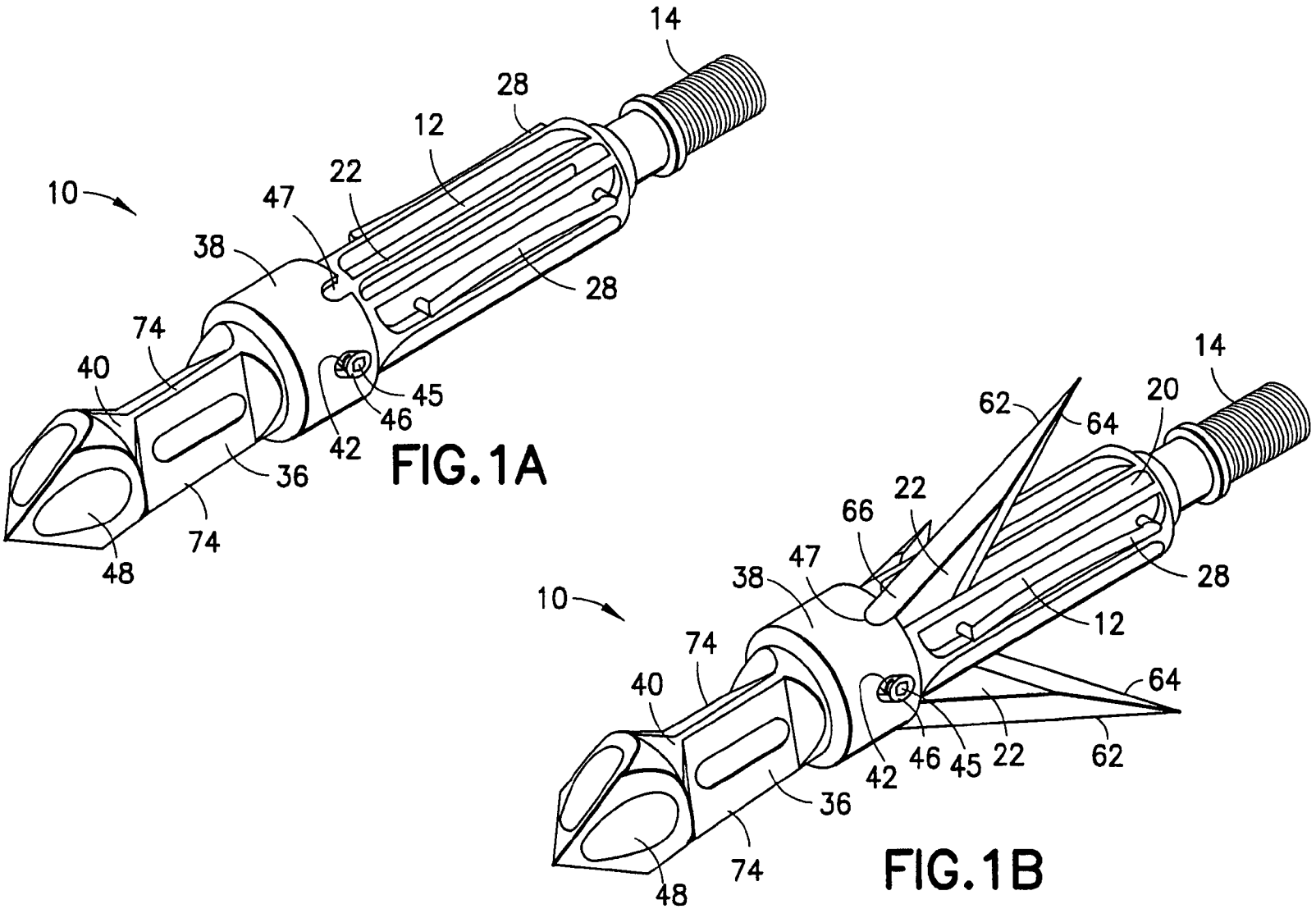
FIGS. 1A and 1B show perspective views of the broadhead in the loaded and deployed positions, respectively, according to the principles of the present invention.

For purposes of the description hereinafter, spatial or directional terms shall relate to the invention as it is oriented in the drawing figures. However, it is to be understood that the invention may assume various alternative variations, except where expressly specified to the contrary. It is also to be understood that the specific components illustrated in the attached drawings, and described in the following specification, are simply exemplary embodiments of the invention. Hence, specific dimensions and other physical characteristics related to the embodiments disclosed herein are not to be considered as limiting.

Referring now to the figures, there is shown a mechanical broadhead, generally indicated as 10, capable of attaching to an arrow wherein the broadhead 10 comprises a broadhead body 12, a front body 36, a front tip 48, retractable cutting blades 22, retaining springs 28 and connecting members 46, such as screws.

Figure 5:
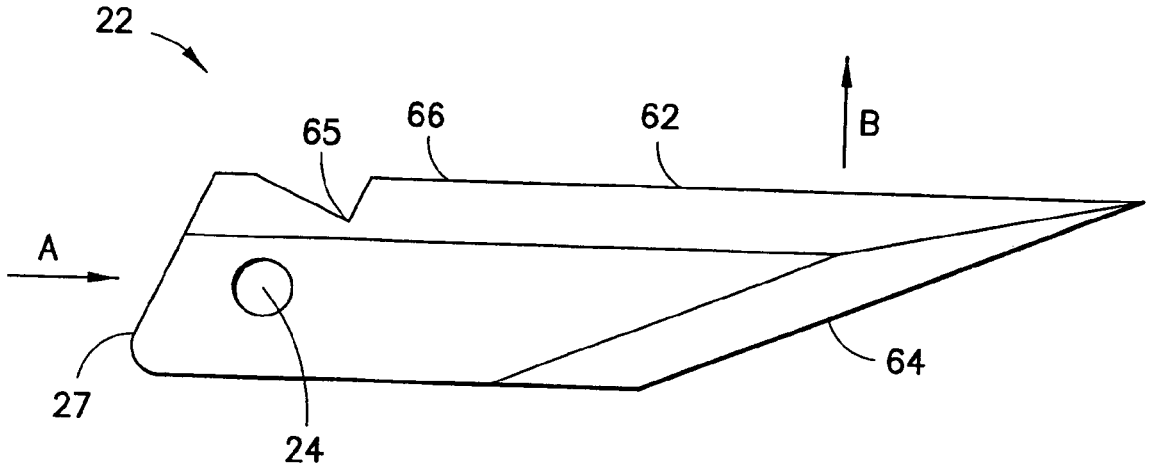
FIG. 5 shows a side view of the blade of FIGS. 1A-1C.

More specifically, the broadhead 10 comprises a broadhead body 12 having a first end 14 capable of removable attachment to an end of an arrow (not shown), a second end 16 including a frontal post 18 extending therefrom, and a body portion including a plurality of blade windows 20 formed therein. The retractable blade 22 is attached within each of the blade windows 20. The blades 22 have a geometrically angled shape, at an end 27, as shown in FIG. 5, and an aperture 24 at a front end 26 thereof for attachment within each of the blade windows 20. The retaining spring 28 retains each of the blades in a retracted position within each of the blade windows 20. The first, or rear, end 14 of the broadhead body 12 has a threaded rear shank that enables the broadhead 10 to be screwed onto the arrow shaft. The broadhead 10 weight was reduced by fluting excess aluminum out of the broadhead body 12.

The front body 36 is provided having a frontal end 40 and a rearward end 38. The rearward end 38 is slidably mounted via an opening 39 onto the frontal post 18 extending from the broadhead body 12. The frontal post has an approximately .125" diameter that inserts into the rearward end 38 of the front body 36. The opening 39 includes a shoulder 37 that extends around the opening 39. The front body 36 includes at least one aperture 42 extending through a sidewall portion 44 thereof. Connecting members 46, such as screws, pins and the like, enter through the sidewall apertures 42 of the front body 36 and the apertures 24 of each of the blades through apertures 68 in the broadhead body 12 to slidably secure the front body 36 to the broadhead body 12 and to pivotally secure each of the blades 22 within the broadhead body 12. The geometrically angled end 27 of the blades 22 contacts the shoulder 37. Apertures 42 in the front body 36 have an elongated shape, preferably an approximate 20 degree twist, to permit movement of the front body 36 with respect to the broadhead body 12. Upon application of a rearward force to the front body 36, the 20 degree pitch for the aperture 42 causes a twisting action of the front body 36 with respect to the broadhead body 12. This twisting action cooperates with the geometrically angled blade end 27, which is in contact with the shoulder 37, to cause the blades 22 to a twisting pivot about connecting members 46 in an outward direction with respect to the broadhead body 12.

The front tip 48 is removably secured to the frontal end 40 of the front body 36, such that upon contact with a target, the front tip 48 and front body 36 act as one to slide rearwardly into an end 27 of the geometrically angled blades 22, applying a force as depicted by arrow "A" in FIG. 5, thus pushing each of the blades 22 outward, in a direction as depicted by arrow "B" in FIG. 5, through the blade windows 20 into a deployed position.

Once the front tip 48 and the front body 36 are slid rearwardly onto the broadhead body 12 and the blades 22 deployed, the front tip 48 and the front body 36 are solidly compacted, thus conveying kinetic energy from the front tip 48 and front body 36 into the broadhead body and into the arrow shaft. This total mechanical deployment function is carried out within 0.050" from the time of target contact to complete deployment. While the drawings show the aperture 42 having a 20 degree twist, one having ordinary skill in the art would recognize that a straight aperture may be used in place of an angled aperture.

Figure 2A:
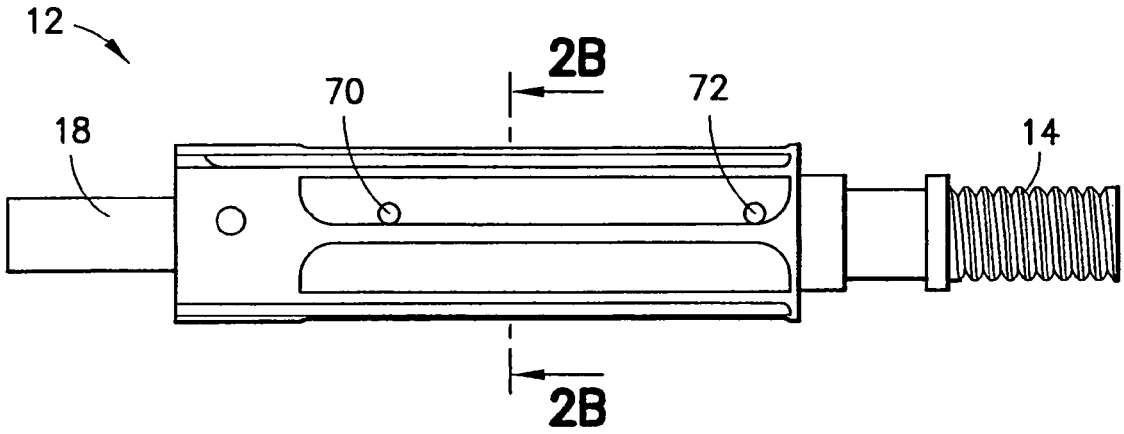
FIG. 2A shows a side view of the broadhead body of FIGS. 1A-1C.
Figure 2B:
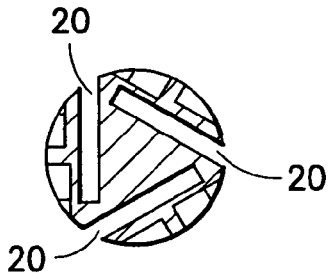
FIG. 2B shows a cross-sectional view of the broadhead body taken along line 2B-2B of FIG. 2A.
Figure 3A:
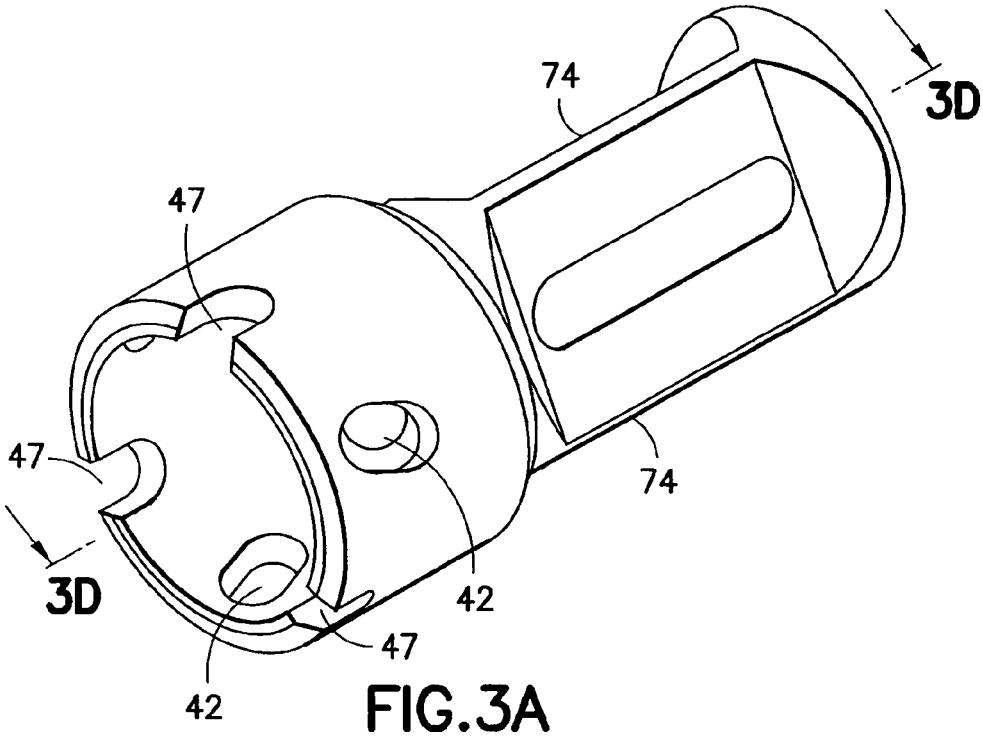
FIGS. 3A and 3B show perspective and side views of the front body of FIGS. 1A-1C.
Figure 3B:
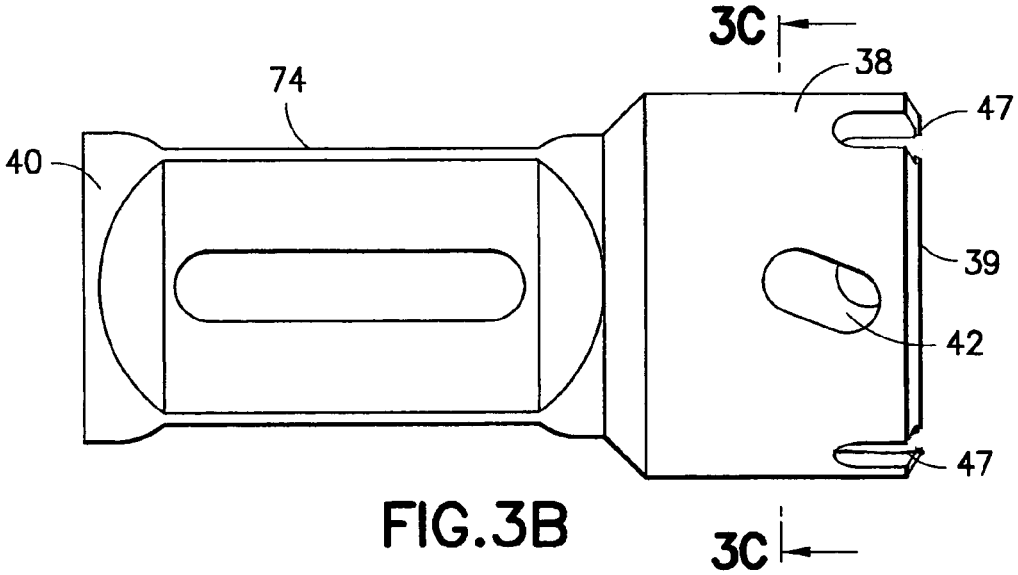
Figure 3C:
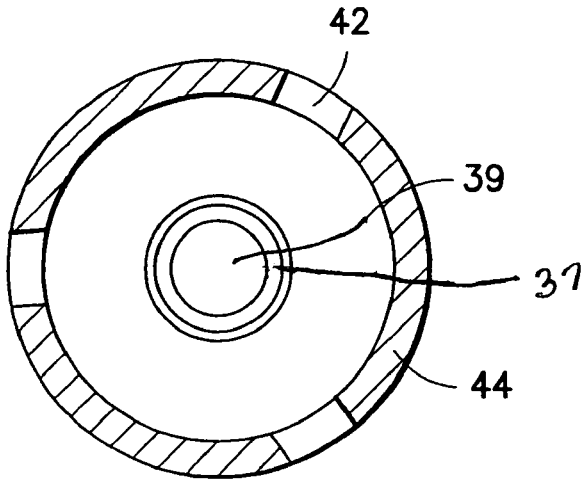
FIG. 3C shows a cross-sectional view of the front body taken along line 3C-3C of FIG. 3B.
Figure 3D:
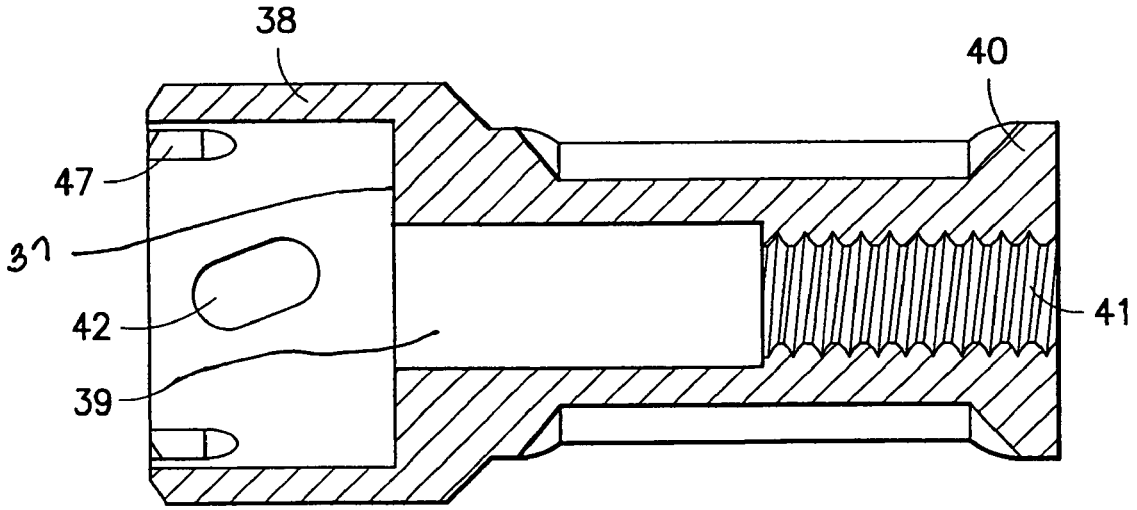
FIG. 3D shows a cross-sectional view of the front body taken along line 3D-3D of FIG. 3A.
Figure 4A:
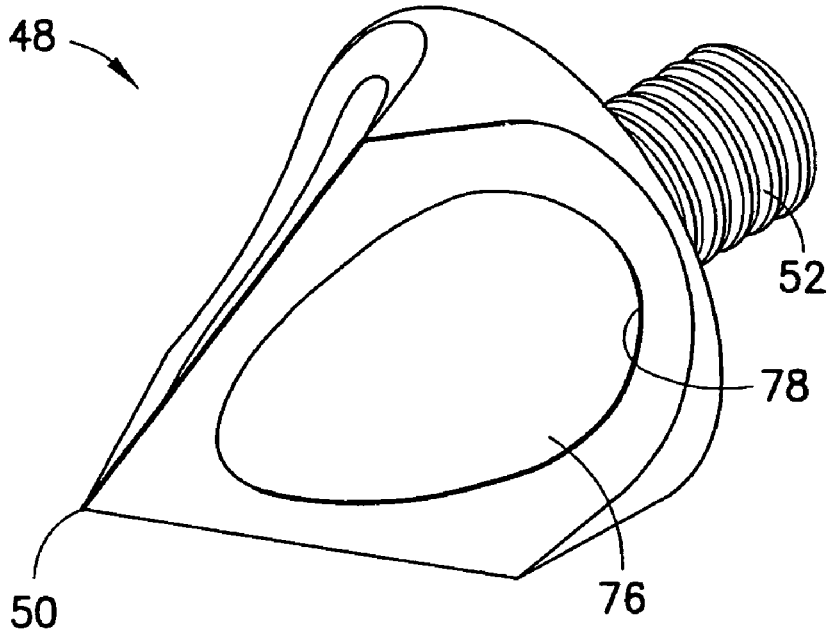
FIGS. 4A-4H show various views of a chiseled front tip according to a first embodiment of the invention.
Figure 4B:
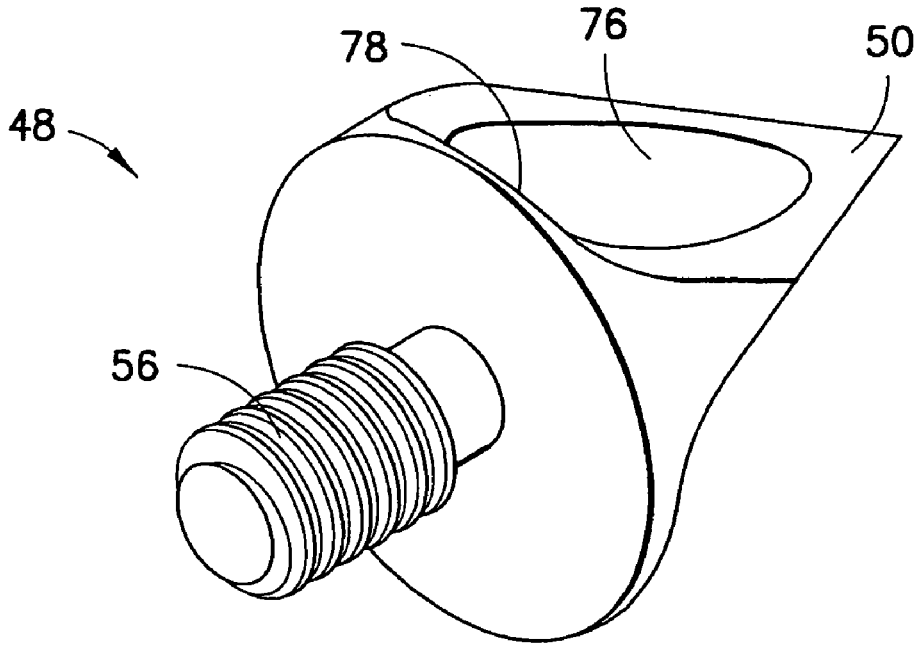
Figure 4C:
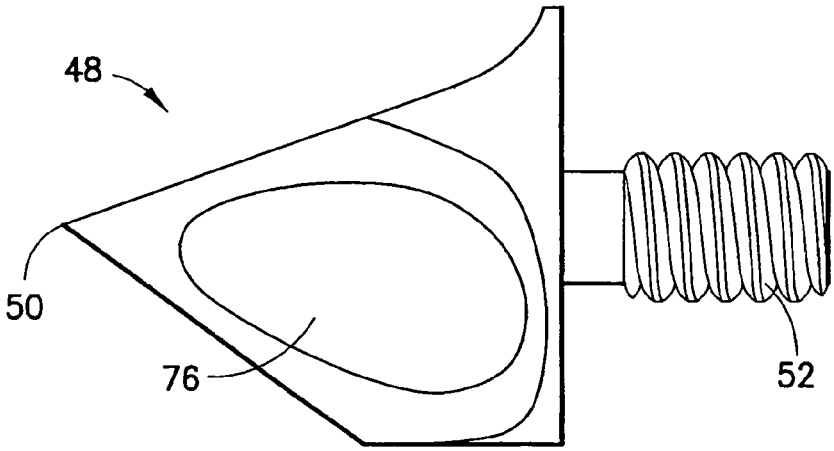
Figure 4D:
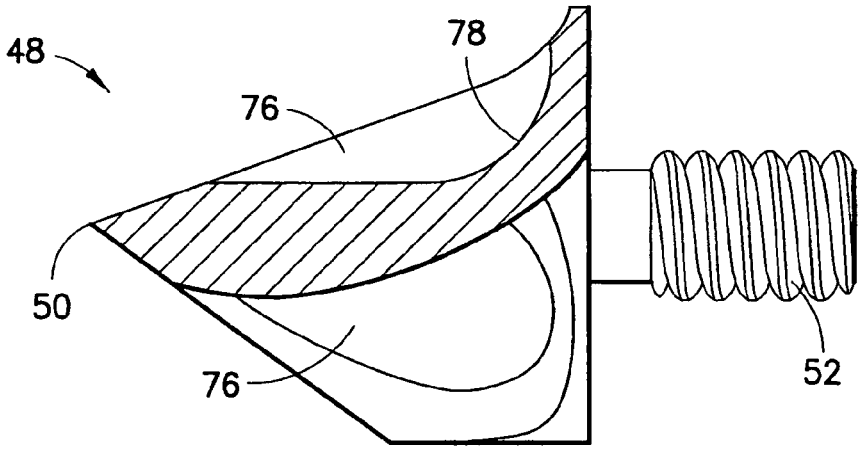
Figure 4E:
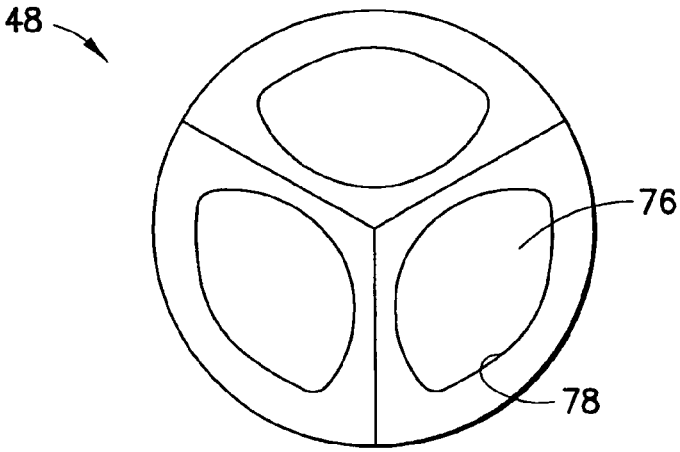
Figure 4F:
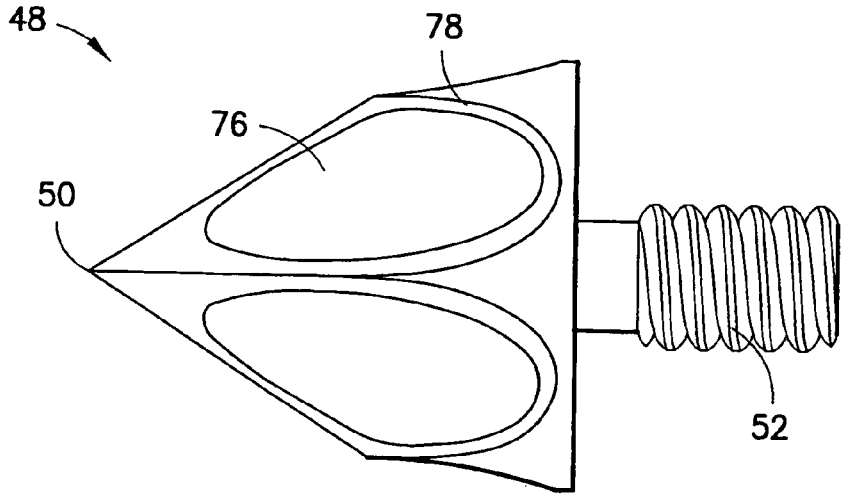
Figure 4G:
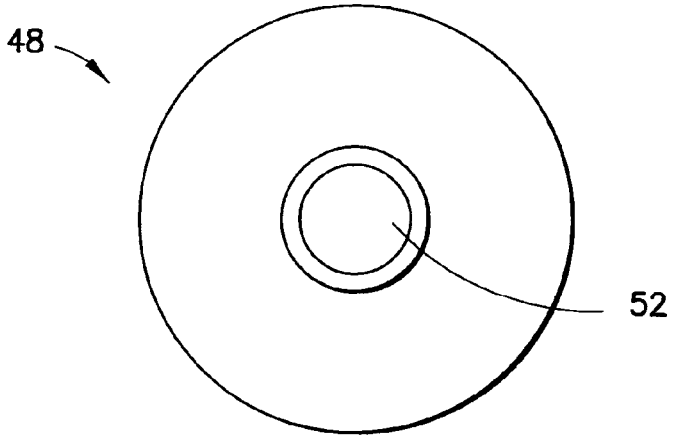
Figure 4H:
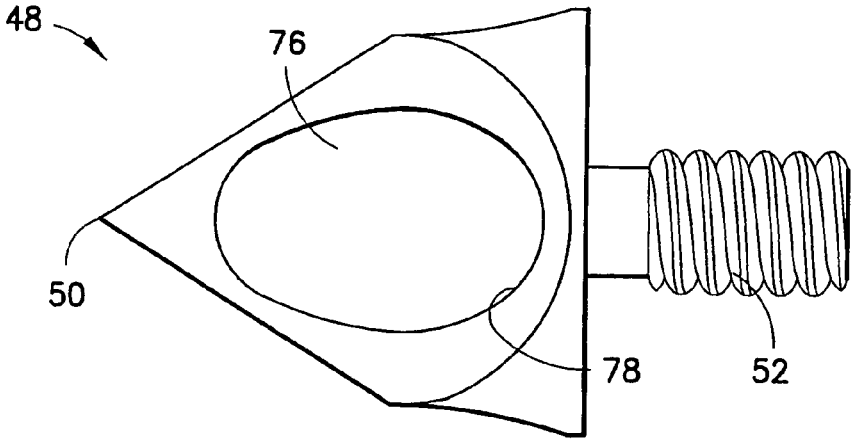

Preferably, the broadhead body 12 includes three windows 20 and associated blades 22 located diametrically at 120 degrees around the body 12, as depicted in the cross-sectional view of the broadhead body 12 of FIG. 2B. The front body 36 is secured to the broadhead body 12 through the use of three separate connecting members 46 which are positioned through apertures 42 which are also located diametrically at 120 degrees around the front body 36 and corresponding apertures 68 which are positioned around the broadhead body 12. The three connecting members 46 continue through the apertures 42 in the front body 36 and the apertures 68 in the broadhead body 12, thus continuing through the geometrical/hinging end apertures 24 of the cutting blades 22 and securely connecting into the inner core of the broadhead body 12 through assembly apertures 68.

Once the cutting blades 22 are inserted into the broadhead body 12 with the geometrical end 27 of the blades 22 protruding from the top of the broadhead body 12, the assembly, consisting of the front tip 48 and the front body 36, will be slid over the end of the frontal post 18 of the broadhead body 12 and the cutting blades 22 will be secured in position with three connecting members 46. Connecting members 46 will be flush with the sidewall 44 of the front body 36. A hole 45, capable of receiving an Allen wrench, is formed in the connecting member 46 to enable one to disassemble the broadhead.

Preferably, the front body 36 has a triangular shape. The blade windows 20 and blades 22 are positioned in alignment with apexes 74 of the triangular shape of the front body. The triangular shape of the front body minimizes weight of the broadhead 10 and aids in the aerodynamic flight of the broadhead. Cut-out openings 47 are provided in the rear end 38 of the front body 36 which are elongated in shape, and contact a notch 65 to assist in the deployment of the blades 22, to permit a portion 66 of the blades 22 to extend therethrough when the broadhead 10 is in the deployed position.

The blade windows 20 accommodate blade deployment and have a size and shape such that when the front tip 48 is in a loaded position and the blades 22 are detracted, the blades 22 are completely contained within the broadhead body 12. The blade movement out of blade windows 20 into the deployment position is such that it minimizes drag and resistance on impact with the target and allows deeper penetration.

Figure 6:
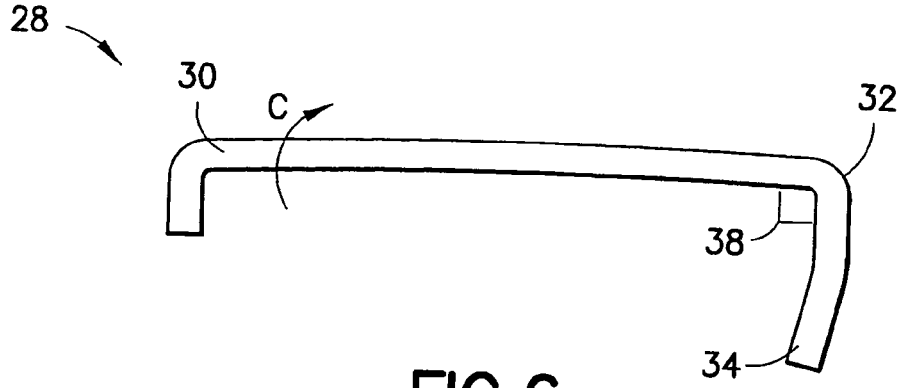
FIG. 6 shows a side view of the retaining spring of FIGS. 1A-1C.

Each of the blades 22 is held within the broadhead body 12 during flight by associated retaining springs 28. For each retaining spring 28, the broadhead body 12 includes pairs of retaining spring holes 70, 72, as shown in FIG. 2A. The retaining springs 28 mount into the broadhead body by the respective retaining spring holes, one rearward 72 and one forward 70. As shown in FIG. 6, each of the retaining springs 28 comprises a stainless steel straight spring wire having an approximate 90 degree angle bend at the rear end 32 of the retaining spring 28. A slight arcuate offset is provided on the rear end 32 of the spring thus forming a friction fit within the rearward retaining spring hole 72. This design creates a downward force on a front end 30 of the spring that is contacting the side of the cutting blade 22 through the forward hole 70, wherein the pressure produced by the spring 28 creates a resistance factor that will hold the blade 22 snugly within the broadhead body 12 to prevent the blades 22 from deploying on shot inertia and, upon contact, adequate shot pressure on the front tip 48 that will allow the blades 22 to slide out from under the retaining springs 28. The front of the retaining springs 28 are bent at an approximate 90 degree angle to snap in behind the blades 22 thus locking them open.

As shown, particularly in FIG. 5, the cutting blades 22 have a slight radial notch 65 on the front cutting edge of the blade 22 to avoid contact with the rear end 38 of the front body 36. As discussed above, the opening 47 is provided in this rear end 38 of the front body to accommodate a portion 66 of the blade 22 extending out from the broadhead body 12 during deployment. The blades 22 are comprised of stainless steel that has been ground on both sides of the blade 22 for sharpness and are geometrically designed to hinge into deployment when force is applied to the frontal hinge end of the blades 22. The blades 22 have a cutting surface on both outside and inside edges 62, 64 of the blade such that the outside edge 62 of the blade 22 will cut on forward entry into the target and the inside edge 64 of the blade 22 will create a back cut upon removal of the blade from the target. This will allow for a greater amount of hemorrhaging of the wound and a quicker kill of the target, hence reducing suffering of the target.

Figure 1C:
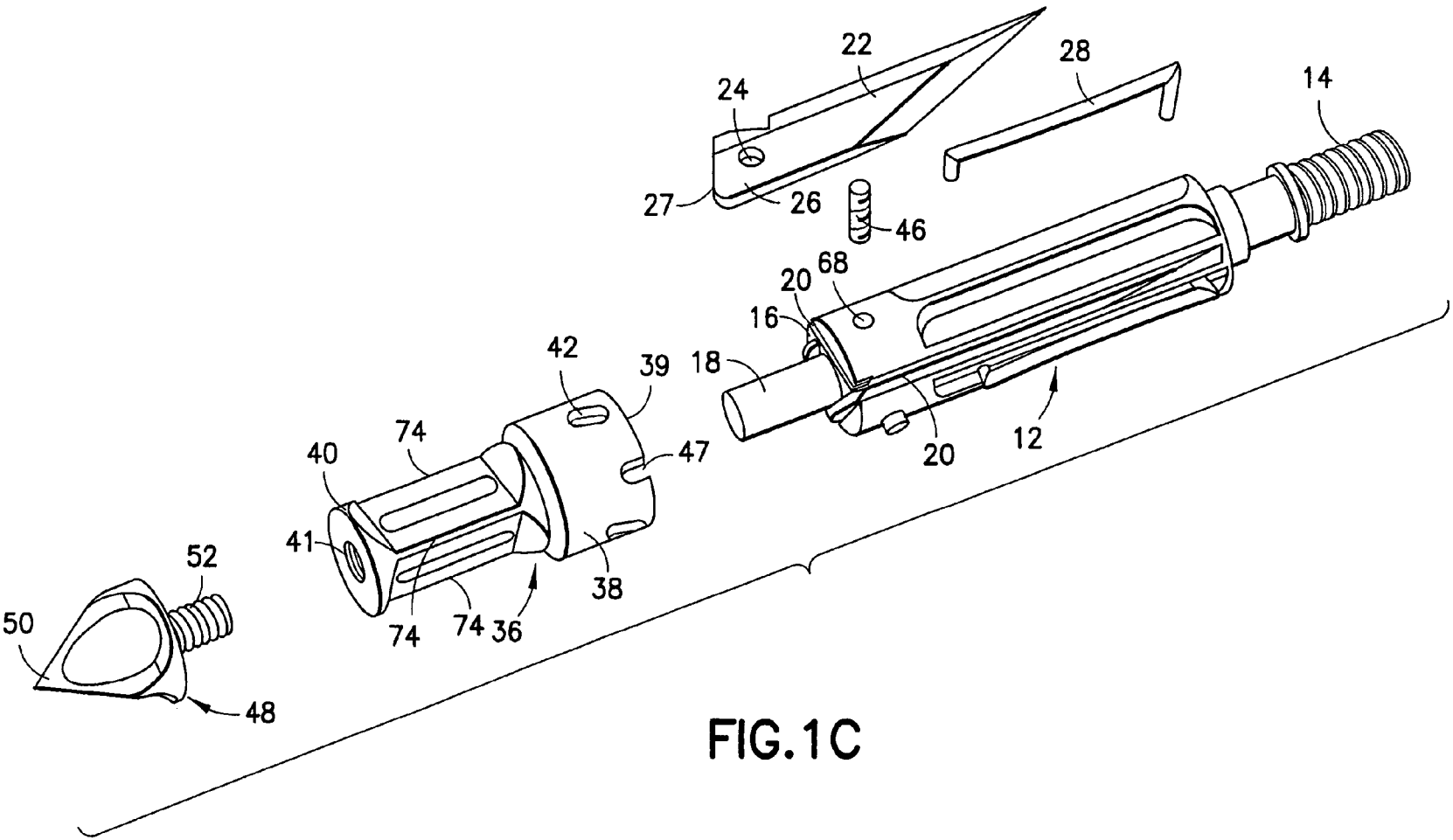
FIG. 1C shows a perspective view of the individual parts of the broadhead according to the principles of the present invention.

As shown in FIGS. 1A-1C and particularly in FIGS. 4A-4H, the front tip 48, according to a first embodiment, comprises a sharp three-sided chisel point 50 containing a threaded shaft 52 that is removably secured within a threaded opening 41 of the frontal end 40 of the front body 36. This chisel point 50 can be formed from stainless steel, titanium or any other known material having sufficient strength characteristics to obtain efficient penetration into the target and create sufficient front-end load which enables broadhead deployment. Preferably, chisel point 50 includes balled out portions 76. These balled out portions 76 may be formed, for example, by the application of ball mills into the tip 48. These balled out portions 76 form a "shelf" 78 which is at an approximate 90 degree angle behind the point 50 to increase the front end load of the broadhead 10 upon contact with the target and allow for a deeper penetration of the broadhead 10 into the target. This is achieved because, upon impact with the target, the shelf 78 forms a "bubble" around the front tip which retards the motion of the broadhead 10 enough to apply a backward force or front end load to the front body 36 such that is causes the blades to deploy after the front tip 48 has deeply penetrated the target. In other words, the shelf 78 on the front tip 48 acts as a "snowplow" behind the chisel point 50, allowing for a deep penetration of the broadhead 10 into the target before deployment of the blades 22.

Figure 7:
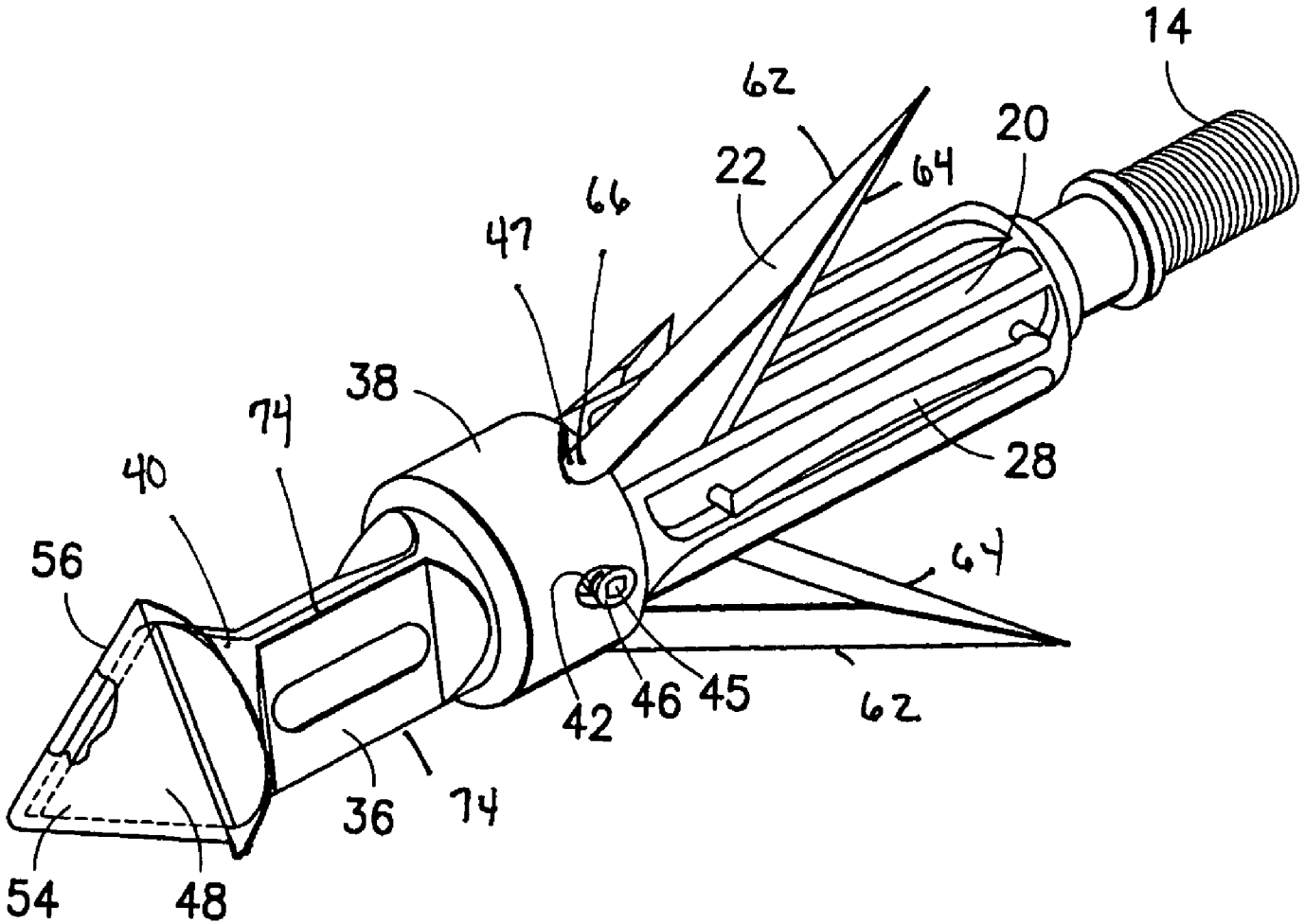
FIG. 7 shows a perspective view of the broadhead of the invention in a deployed position including a razor point front tip according to a second embodiment of the invention.

According to a second embodiment, as shown in FIG. 7, the front tip 48 may comprise a cut-from-the-start razor tip or a two-sided razor 54 containing a threaded shaft that is removably secured to the front body 36. In this embodiment, the razor 54 may be enclosed within a cone-shaped sacrificial plastic sleeve 56 wherein the plastic sleeve 56 breaks off upon contact with the target.

The broadhead 10 of the present invention may be reset by simply inserting a sharp object, such as a knife tip, under the front end 30 of the retaining spring 28 and using a screwdriver twisting type motion, as depicted by arrow "C" in FIG. 6. This twisting motion will allow the spring 28 to slide out from behind the blade 22 allowing it to retract back into the broadhead body 12 and into the loaded position. The tip of the front end 30 of the spring enters through the front hole 70 of the broadhead body 12 to contact the side of the blade 22. This front end tip of the spring applies a frictional force to the blade 22 to maintain it in a retracted position. Upon application of a rearward force to the front tip 48 and front body 36, the front body 36 slides rearwardly to cause movement of the blade 22 to overcome the frictional force applied thereto from the tip of the front end 30 of the retaining spring 28. This causes the blades to deploy and the tip of the front end 30 of the retaining spring 28 to snap into place beneath the blade 22 and maintain the blade 22 in the deployed position. The blade 22 cannot be retracted until the front end 30 of the retaining spring 28 is manually lifted from behind the blade 22 and the blade 22 is then manually pushed back into the blade window in the loaded position.

While the figures depict a three-bladed broadhead device, two or even four or more bladed designs can be encompassed by the present invention. The current invention reduces stress on the blades, provides an improved cutting design, and has a geometrically unique design for the front tip, front body, broadhead body, cutting blades, and retaining springs to work together. The design of this invention, specifically the geometry of the blade angle and the outside and inside razor edges of the blades in conjunction with the front tip, the front body, and the broadhead body, will provide an improved broadhead that will achieve a better arrow flight, better transition of kinetic energy from front tip through arrow, and a more deadly cut when there is not a complete pass through the target. Additionally, the three-sided chiseled tip allows for a great front end load and deeper penetration of the broadhead into the target prior to deployment of the blades.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of this description. For example, it is to be understood that the present invention contemplates that, to the extent possible, one or more features of any embodiment can be combined with one or more features of any other embodiment.

The invention claimed is:

1. A mechanical broadhead for attachment to an arrow, said broadhead comprising:

(a) a broadhead body having a first end capable of attachment to an end of an arrow, a second end including a frontal post extending therefrom and a body portion including a plurality of blade windows formed therein;

(b) a retractable blade attached within each of said plurality of blade windows, each of said blades having a geometrically angled shape and an aperture at a front end thereof for attachment within each of said plurality of blade windows;

(c) a retaining spring which generates a force for retaining each of said blades in a retracted position within each of said blade windows of said broadhead body;

(d) a front body having a frontal end and a rearward end, said rearward end slidably mounted onto said frontal post of said broadhead body extending from said broadhead body, said front body including at least one aperture extending through a sidewall portion thereof;

(e) connecting members for entering through said at least one aperture of said front body and said apertures of each of said blades for slidably securing said front body to said broadhead body and for pivotally securing each of said blades within said broadhead body; and (f) a front tip secured to said forward end of said front body, wherein such that upon contact with a target, said front tip and said front body slide rearwardly into the front end of said geometrically angled blades, thus pushing each of said blades against the force of the retaining spring and through said blade windows into a deployed position and wherein each of said retaining springs snaps into place to hold each of said blades in said deployed position.

2. The broadhead as set forth in claim 1 wherein said front tip comprises a sharp chisel point having at least two sides containing a shaft portion that is secured to said front body.

3. The broadhead as set forth in claim 2 wherein said chisel point is formed from one of stainless steel and titanium.

4. The broadhead as set forth in claim 2 wherein said chisel point includes balled out portions forming a shelf behind the point to increase the front end load of the broadhead upon contact with said target and allow for a deeper penetration of the broadhead into the target.

5. The broadhead as set forth in claim 1 wherein said front tip comprises a two-sided razor containing a shaft portion that is secured to said front body and wherein said razor is enclosed within a sacrificial plastic sleeve wherein said plastic sleeve breaks off upon contact with said target.

6. The broadhead as set forth in claim 1 wherein said blade windows accommodate blade deployment and said windows have a size and shape such that when said front tip is in a loaded position and the blades are detracted, said blades are completely contained within the broadhead body.

7. The broadhead as set forth in claim 1, wherein said broadhead body includes pairs of retaining spring holes and said retaining springs mount into the broadhead body by the respective retaining spring holes, one rearward and one forward, each of said retaining springs including an approximate 90 degree angle bend having a slight arcuate offset at its end on the rear of the spring thus creating a downward force on the front of the spring that is contacting the side of the cutting blade through the forward hole, wherein the pressure produced by the spring creates a resistance factor that will hold the blade snugly within the broadhead body to prevent said blades from deploying on shot inertia and, upon contact, adequate shot pressure on the front tip will allow the blades to slide out from under said retaining springs and said retaining springs will snap in behind the blades thus locking them open.

8. The broadhead as set forth in claim 1 wherein said geometrically angled shape of said blades comprises an end, adjacent to said aperture and attachment location, having an upwardly angled shape to create a leverage point on the end of the blade such that upon contact of said front body with said end forces the blade out of the body into the deployed position, wherein the blade movement is such that it minimizes drag and resistance on impact and allows deeper penetration.

9. The broadhead as set forth in claim 1 wherein said blades have a cuffing surface on the outside and inside edges of the blade such that the outside edge of the blade will cut on forward entry into the target and the inside edge of the blade will create a back cut upon removal of the blade from the target.

10. The broadhead as set forth in claim 1 wherein said plurality of blade windows comprises three windows having an associated blade secured therein by said connecting member.

11. The broadhead as set forth in claim 1 wherein said front body has a triangular shape and wherein said blade windows and blades are in alignment with the apexes of said triangular shape of said front body and wherein said broadhead body is sculpted to minimize weight.

12. The broadhead as set forth in claim 1 wherein said sidewall apertures in said front body are elongated in shape to permit sliding movement of said front body with respect to said broadhead body.

13. The broadhead as set forth in claim 1 wherein said first end of said broadhead body is threaded for removable attachment onto the end of an arrow shaft.

14. The broadhead as set forth in claim 1 wherein said deployed blades may be retracted to load the broadhead by the application of a twisting force beneath a forward end of said retaining springs.

15. The broadhead as set forth in claim 1 wherein the first end of the broadhead body is removably attached to the end of the arrow and the front tip is removably secured to the forward end of the front body.

16. A mechanical broadhead for attachment to an arrow, said broadhead comprising:

(a) a broadhead body having a first end for attachment to an end of an arrow, a second end including a frontal post extending therefrom and a body portion including a plurality of blade windows formed therein;

(b) a retractable blade attached within each of said plurality of blade windows;

(c) a retaining spring for retaining each of said blades in a retracted position within each of said blade windows of said broadhead body;

(d) a front body slidably mounted onto said frontal post extending from said broadhead body;

(e) connecting members for securing said front body to said broadhead body and for securing each of said blades within said broadhead body; and (f) a front tip secured to said front body, such that upon contact with a target, said front tip and said front body slide rearwardly into an end of said blades, thus pushing each of said blades through said blade windows into a deployed position, wherein said front tip comprises a sharp chisel point having at least two sides containing a shaft portion that is secured to said front body and wherein said chisel point includes balled out portions forming a shelf behind the point to increase the front end load of the broadhead upon contact with the target.

17. The broadhead as set forth in claim 16 wherein said blade windows accommodate blade deployment and said windows have a size and shape such that where said front tips is in a loaded position and the blades are detracted, said blades are completely contained within the broadhead body.

18. The broadhead as set forth in claim 16 wherein each of said retaining springs are mounted to said broadhead body through a forward and rearward retaining spring hole and said retaining springs are configured to lock said blades in position after deployment.

19. A mechanical broadhead for attachment to an arrow, said broadhead comprising:

(a) a broadhead body having a first end for attachment to an end of an arrow, a second end including a frontal post extending therefrom and a body portion including a plurality of blade windows formed therein;

(b) a retractable blade attached within each of said plurality of blade windows;

(c) a retaining spring for retaining each of said blades in a retracted position within each of said blade windows of said broadhead body and wherein once deployed, the blades may be retracted to load the broadhead by the application of a twisting force beneath a forward end of said retaining springs;

(d) a front body slidably mounted onto said frontal post extending from said broadhead body;

(e) connecting members for securing said front body to said broadhead body and for securing each of said blades within said broadhead body; and (f) a front tip secured to said front body, such that upon contact with a target, said front tip and said front body slide rearwardly into an end of said blades, thus pushing each of said blades through said blade windows into a deployed position.

20. The broadhead as set forth in claim 19 wherein said front tip comprises a sharp chisel point having at least two sides containing a shaft position that is secured to said front body and wherein said chisel point includes balled out portions forming a shelf behind the point to increase the front end load of the broadhead upon contact within the target.

21. The broadhead as set forth in claim 19 wherein said blades have a cutting surface on the outside and inside edges of the blade such that the outside edge of the blade will cut on forward entry into the target and the inside edge of the blade will create a back cut upon removal of the blade from the target.

22. A mechanical broadhead for attachment to an arrow, said broadhead comprising:

(a) a broadhead body having a first end for attachment to an end of an arrow, a second end including a frontal post extending therefrom and a body portion including a plurality of blade windows formed therein;

(b) a retractable blade attached within each of said plurality of blade windows;

(c) a retaining spring for retaining each of said blades in a retracted position within each of said blade windows of said broadhead body;

(d) a front body slidably mounted onto said frontal post extending from said broadhead body;

(e) connecting members for securing said front body to said broadhead body and for securing each of said blades within said broadhead body; and (f) a front tip secured to said front body, such that upon contact with a target, said front tip and said front body slide rearwardly into an end of said blades, thus pushing each of said blades through said blade windows into a deployed position, wherein each of said retaining springs are mounted to said broadhead body through a forward and rearward retaining spring hole and said retaining springs are configured to lock said blades in position after deployment.

* * * * *